US007077677B2

(12) United States Patent
Sanuki

(10) Patent No.: US 7,077,677 B2
(45) Date of Patent: Jul. 18, 2006

(54) CIRCULAR CONNECTOR ASSEMBLY

(75) Inventor: Hidenori Sanuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/905,753

(22) Filed: Jan. 19, 2005

(65) Prior Publication Data

US 2005/0208820 A1 Sep. 22, 2005

(30) Foreign Application Priority Data

Mar. 17, 2004 (JP) ..... 2004-075767

(51) Int. Cl.
*H01R 13/62* (2006.01)
*H01R 13/213* (2006.01)

(52) U.S. Cl. ..... 439/318; 439/315; 439/321

(58) Field of Classification Search ..... 439/318, 439/321, 320, 314, 317, 319, 315, 310–311, 439/488–489, 491
See application file for complete search history.

(56) References Cited

U.S. PATENT DOCUMENTS

| | | | | |
|---|---|---|---|---|
| 4,497,530 | A * | 2/1985 | Shannon | 439/488 |
| 5,662,488 | A * | 9/1997 | Alden | 439/314 |
| 6,386,897 | B1 * | 5/2002 | Muller | 439/314 |
| 6,811,423 | B1 * | 11/2004 | Yoshigi et al. | 439/318 |

FOREIGN PATENT DOCUMENTS

| | | |
|---|---|---|
| EP | 0 189 857 A | 8/1986 |
| JP | 4-132178 | 5/1992 |
| JP | 10-154553 | 6/1998 |
| JP | 2001-6814 | 1/2001 |

* cited by examiner

*Primary Examiner*—Tho D. Ta
*Assistant Examiner*—Felix O. Figueroa
(74) *Attorney, Agent, or Firm*—Armstrong, Kratz, Quintos, Hanson & Brooks, LLP

(57) ABSTRACT

A temporary locking projection for mounting the engaging ring at a reference position for assembly, and a detecting locking projection positioned forward of the temporary locking projection in a rotating direction of the engaging ring are provided on an outer periphery of the male connector housing and projected outward in a radial direction thereof. A temporary locking wall extending in an axial direction of the engaging ring for engaging with the temporary locking projection, and a resilient locking arm having a locking hook at an inner distal end surface are provided on an outer surface of the engaging ring. The locking hook is engaged with the detecting locking projection. A contact surface for contacting the resilient locking arm is provided at a projecting end of the detecting locking projection. A step having a contact surface for contacting the contact surface of the detecting locking projection is provided on the resilient locking arm.

6 Claims, 7 Drawing Sheets

CIRCULAR CONNECTOR ASSEMBLY

BACKGROUND OF THE INVENTION

The priority application Number Japanese Patent Application 2004-075767 upon which this patent application is based is hereby incorporated by reference.

1. Field of the Invention

This invention relates to a circular connector assembly, of which male and female connectors are electrically connected to each other via an engaging ring for use in, for example, a transmission of a vehicle.

2. Description of the Related Art

As shown in FIGS. 8 and 9, Japanese published unexamined patent applications No. Hei 04-132178 (pages 4 to 6, FIG. 1) and Hei 10-154553 (page 3 to 5, FIG. 1) disclose first and second embodiments of conventional circular connector assemblies 70 in FIG. 8, 80 in FIG. 9. The circular connector assembly 70 is a multipin connector assembly accommodating a plurality of terminals 72, 74. A male and female connectors 71, 73 of the circular assembly 70 are connected to each other by rotating an engaging ring 76. Generally, force for connecting the male and female connectors increases as a number of terminals increases. However, the connectors 71, 73 of the circular connector assembly 70 are easily connected to each other by rotating the engaging ring 76 with a small force without prying the terminals 72, 74.

As shown in FIG. 8, the conventional circular connector assembly 70 includes a male connector 71 having female terminals 72; a female connector 73 having male terminals 74, and a helical groove 75 on an outer surface thereof, and being connected to the male terminal 71; and an engaging ring 76 mounted rotatably on the male connector 71, and having projections 77 for engaging with the helical groove 75. Thereby, after the projections 77 are engaged with the helical groove 75, rotating the engaging ring 76 makes the male and female connectors 71, 73 connected to each other. When the male and female connectors 71, 73 are connected to each other, the male and female terminals 74, 72 are electrically connected to each other.

As shown in FIG. 9, the conventional circular connector assembly 81 allows to recognize a fitting condition of the male 81 and female (not shown) connectors. This assembly 80 includes the male 81 and female connectors; an engaging ring 85 mounted rotatably on the male connector 81 to connect the male 81 and female connectors; and a detector 86 mounted on a receiving part 82*a* as a concave formed on an outer periphery of a flange 82 of the male connector 81 to indicate the fitting condition of the male 81 and female connectors.

A circular guiding rail 83 is provided on an outer surface of the male connector 81. A guiding part (not shown) provided on an inner surface of the engaging ring 85 engages with the guiding rail 83, and thereby the engaging ring 85 is rotatably mounted on the male connector 81. The detector 86 is mounted, slidably in an axis direction of the circular connector assembly, on the receiving part 82*a* of the flange 82.

The female connector (not shown) includes a hood (not shown) for receiving the male connector 81. A helical groove (not shown) is formed on an outer surface of the hood. When a projection (not shown) formed on the inner surface of the engaging ring 85 is engaged with the helical groove, and the engaging ring 85 is rotated in a counterclockwise direction, the male 81 and female connectors approach each other in the axis direction of the assembly 80 to be connected to each other.

The detector 86 includes an engaging projection 86*a*, which projects toward the engaging ring 85 for detecting an engagement between the connectors. This engaging projection 86*a* engages with an engaging concave 85*a* formed at a front end of the engaging ring 85. An engaging concave 85*a* is formed on a periphery of the engaging ring 85 at a reference position for assembling. Only when the engaging concave 85*a* faces the engaging concave 85*a*, the engaging convex 86*a* of the detector 86 is engaged with the engaging concave 85*a*. This circular connector assembly is designed that when the detector faces the engaging concave 85*a*, the male 81 and female connectors are fully engaged with each other. Otherwise, the engaging convex 86*a* is not engaged with the engaging concave 85*a*, and the detector 86 is projected from an end surface of the flange 82. Namely, the fitting state of the male 81 and female connectors is detected by whether the engaging projection 86*a* of the detector 86 is engaged with the engaging concave 85*a* of the engaging ring, or not.

As a third embodiment, Japanese published unexamined patent application No. 2001-6814 (page 3) discloses a conventional circular connector assembly (not shown). Male and female connectors of the assembly are pressed in an axial direction of the assembly to be connected to each other. An engaging ring is rotated to disconnect the male and female connectors.

However, there are problems as described below in the conventional circular connector assemblies. Regarding the first embodiment as the circular connector assembly 70 shown in FIG. 8, whether the connectors 71, 73 are fully connected to each other or not is only detected by a torque feeling (operator's judgement that the engaging ring could not rotate further). Therefore, sometimes a half-fitting condition of the connectors 71, 73 is mistaken for a fully fitting condition. Thus, reliability of the circular connector assembly 70 is not high.

Regarding the second embodiment as the circular connector assembly 80 in FIG. 9, there is a problem that a number of components of the assembly 80 to be managed is increased, and a management of the components of the assembly 80 is troublesome. Further, a number of operation steps for connecting the connectors is increased by one, since the detector 86 is pressed into the engaging ring 85 for detecting the fitting condition of the connectors after connecting the connectors.

Regarding the third embodiment of the circular connector assembly, there is a problem similar to the first embodiment that the fitting condition of the male and female connectors of the assembly is not detected surely, and sometimes a half-fitting condition of the connectors is mistaken for a fully fitting condition.

Accordingly, it is an object of this invention to provide a circular connector assembly that allows to improve fitting reliability of male and female connectors without increasing a number of components of the assembly, and to improve maintenance workability of the assembly due to connecting and disconnecting the male and female connectors easily, and adapts to miniaturization of such as an engine room.

SUMMARY OF THE INVENTION

In order to attain the object, according to this invention, there is provided a circular connector assembly including:

a rotatable engaging ring arranged in between male and female connectors for moving the connectors in a direction of engaging the connectors with each other;

a detector being provided on an outer surface of one of the male and female connectors on which the engaging ring is mounted, for detecting a fitting state of the connectors and preventing the engaging ring from rotating in a reverse direction; and a resilient locking arm being provided to form a free end on the engaging ring, extending in a rotating direction of the engaging ring for engaging with the detector.

According to the above, after the male and female connectors are initially and shallowly engaged with each other, as the engaging ring is rotated, the male and female connectors are shifted in a direction of engaging the connectors with each other, and engaged deeply with each other. When the connectors are fully engaged with each other, the resilient locking arm of the engaging ring is engaged with the detector to prevent the engaging ring from rotating in a reverse direction. Since the resilient locking arm is a free end extending along a radial direction, the resilient locking arm is prevented from being bent or twisted. Further, the resilient locking arm is prevented from projecting outward in a radial direction. Thereby, the connector assembly is prevented from being upsized, and is adapted for a downsized engine room and the like.

According to the invention, preferably, there is provided the circular connector assembly as described above, wherein the resilient locking arm intersects with a support projecting from an outer peripheral wall of the engaging ring, wherein a locking part and an unlocking part are provided integrally on both sides of the locking arm respectively.

According to the above, pushing the unlocking portion raises the locking hook to release the engagement between the resilient locking arm and a detector. Therefore, the male and female connectors are disengaged easily, and maintenance workability is improved.

According to the invention, preferably, there is provided the circular connector assembly as described above, further including a temporary locking projection and a temporary locking wall. The temporary locking projection is provided on an outer peripheral wall of one of the male and female connectors on which the engaging ring is mounted. The temporary locking wall is provided on the engaging ring to be engaged with the temporary locking projection for locking the engaging ring at a reference position for assembly.

According to the above, an engagement between the temporary locking projection of the one connector and the temporary locking wall of the engaging ring positions the engaging ring at the reference position, and engages initially and shallowly the temporary locking projection with the temporary locking wall. Therefore, terminals are prevented from being deformed when the male and female connectors are engaged, and workability for the engagement is improved.

According to the invention, preferably, there is provided the circular connector assembly as described above, further including protecting walls and a coupling wall. The protecting walls are provided on the engaging ring at both sides of the resilient locking arm in a circumferential direction of the engaging ring. The coupling wall is provided on the engaging ring along the resilient locking arm in the circumferential direction of the engaging ring for coupling the protecting walls. The protecting and coupling walls are taller than the resilient locking arm projecting from the engaging ring.

According to the above, the protecting and coupling walls protect the resilient locking arm from outer interference. Therefore, accidental release of an engagement between the resilient locking arm and the detector is prevented. Therefore, the workability for the engagement is improved.

According to the invention, preferably, there is provided the circular connector assembly as described above, wherein the detector is a locking projection having a contact surface for contacting the resilient locking arm, and the resilient locking arm includes a step having a contact surface for contacting the contact surface of the locking projection.

According to the above, when the engaging ring is rotated to engage the resilient locking arm with the detector, due to resilient force of the resilient locking arm, the contact surface of the step of the resilient locking arm contacts the contact surface of the detector, and locking sound is generated to indicate a full engagement between the male and female connectors. Therefore, whether the male and female connectors are fully engaged or not is recognized by the sound, and reliability of the engagement is significantly improved.

According to the invention, preferably, there is provided the circular connector assembly as described above, wherein a slope is provided on a rear of the detector (locking projection) in a rotating direction of the engaging ring, wherein a locking surface is provided on a front side of the detector in a rotating direction of the engaging ring, wherein a locking hook, to be passed over the slope and locked on the locking surface of the detector, is projected inwardly from the resilient locking arm.

According to the above, when the locking hook of the resilient locking arm is raised on the slope, the resilient locking arm is resiliently deformed outward, and when the locking hook is passed over the locking projection, the resilient locking arm is restored to be locked on the locking surface of the locking projection. Therefore, the male and female connectors are reliably prevented from being disengaged by releasing the locking hook from the detector due to such as a vibration of a moving vehicle, and the reliability of the engagement of the male and female connectors is improved.

According to the invention, preferably, there is provided the circular connector assembly as described above, wherein when the engaging ring is rotated in a reverse direction, the locking hook of the resilient locking arm so contacts the locking surface of the detector as to be drawn inwardly in a radial direction of the engaging ring.

According to the above, when the engaging ring is rotated in a reverse direction, the resilient locking arm is drawn inwardly in a radial direction of the one connector. Thereby, the locking hook and the detector is engaged further. Therefore, an accidental release of an engagement between the locking hook and the detector is prevented, and the reliability of the engagement between the male and female connectors is further improved.

The above and other objects, features, and advantages of this invention will be better understood when taken in connection with the accompanying drawings and description.

DESCRIPTION OF THE PREFERRED EMBODIMENTS

Figure 1:
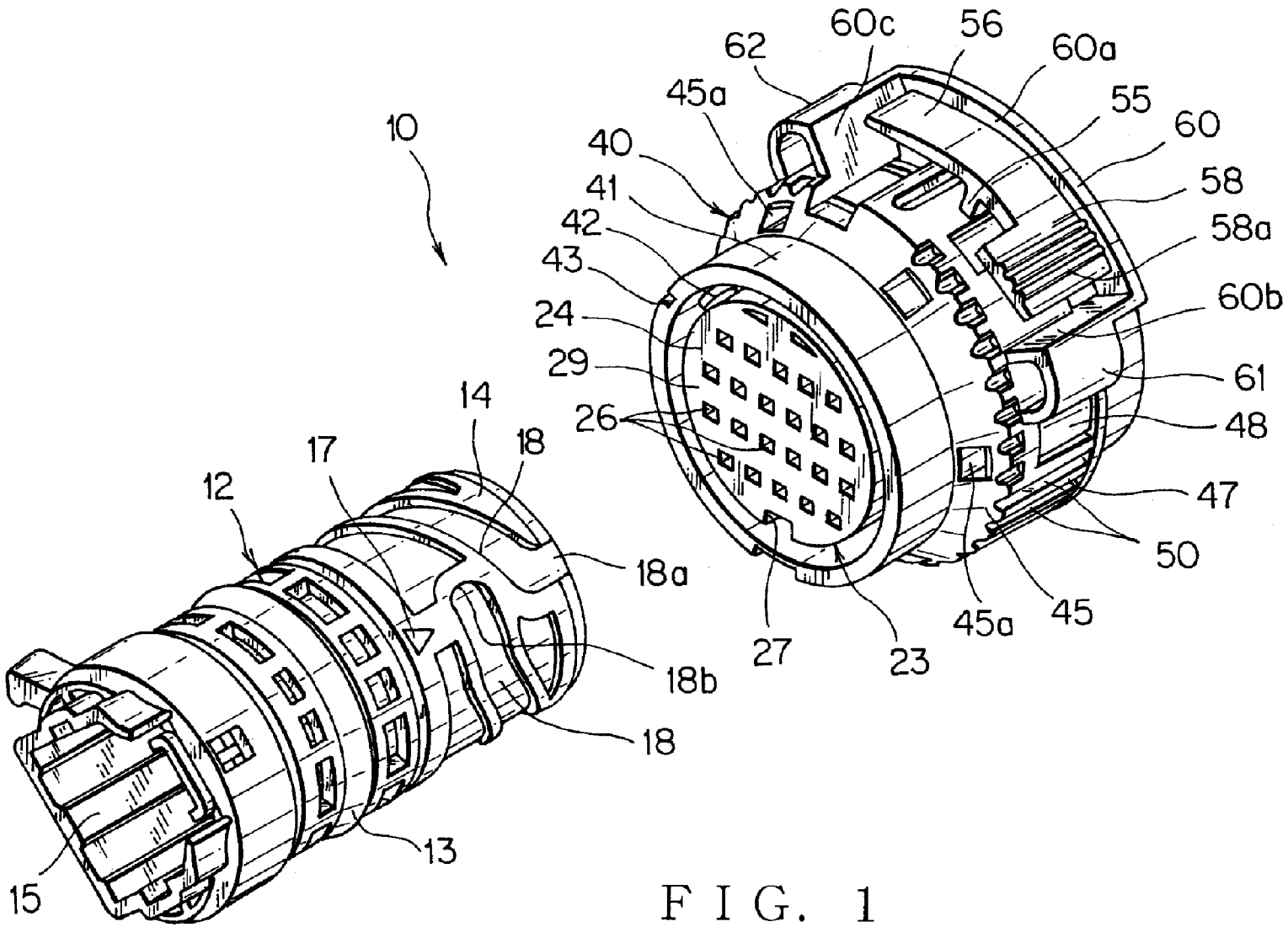
FIG. 1 is an exploded perspective view showing an embodiment of a circular connector assembly according to this invention.

An embodiment of a circular connector assembly according to this invention will be explained below with reference to Figures.

A circular connector assembly 10 is used as a transmission of a vehicle and the like. Male and female multiway connectors 23, 12 are engaged with each other through an engaging ring 40. An engagement between the male and female connectors electrically connects male and female terminals 20, 34 in twenty-two ways to supply signal currents from such as an Electronic Control Unit (ECU).

The circular connector assembly 10 of this embodiment allows to recognize a full engaging state of the male and female connectors 23, 12 visually, aurally, and by a feel of a rotation of the engaging ring 40. Therefore, engaging reliability between the male and female connectors 23, 12 is improved. A temporary locking projection 31 for mounting the engaging ring 40 at a reference position for assembly, and a detecting locking projection (detector) 30 positioned forward of the temporary locking projection 31 in a rotating direction of the engaging ring 40 are provided on an outer periphery of the male connector housing 24, and projected outward in a radial direction of the male connector housing 24. A temporary locking wall 60*b* extending in an axial direction of the engaging ring 40 for engaging with the temporary locking projection 31, and a resilient locking arm 56 having a locking hook 56*a* at an inner distal end surface are provided on an outer surface of the engaging ring 40. The locking hook 56*a* is engaged with the detecting locking projection 30. A contact surface 30*c* for contacting the resilient locking arm 56 is provided at a projecting end of the detecting locking projection 30. A step 57 having a contact surface 57*a* for contacting the contact surface 30*c* is provided on the resilient locking arm 56.

Main components of the circular connector assembly 10 of this embodiment and functions of the main components will be explained in detail below. As shown in FIG. 1, the circular connector assembly 10 includes the female connector 12, the male connector 23, and the engaging ring 40 mounted on the male connector 23. For a convenient explanation as follows, each front side of the male and female connectors 23, 12 means an engagement side between the connectors 23, 12, and each rear side of the connectors 23, 12 means an electric wires leading side, said electric wires are connected to the male or female terminals 20, 34.

Figure 2:
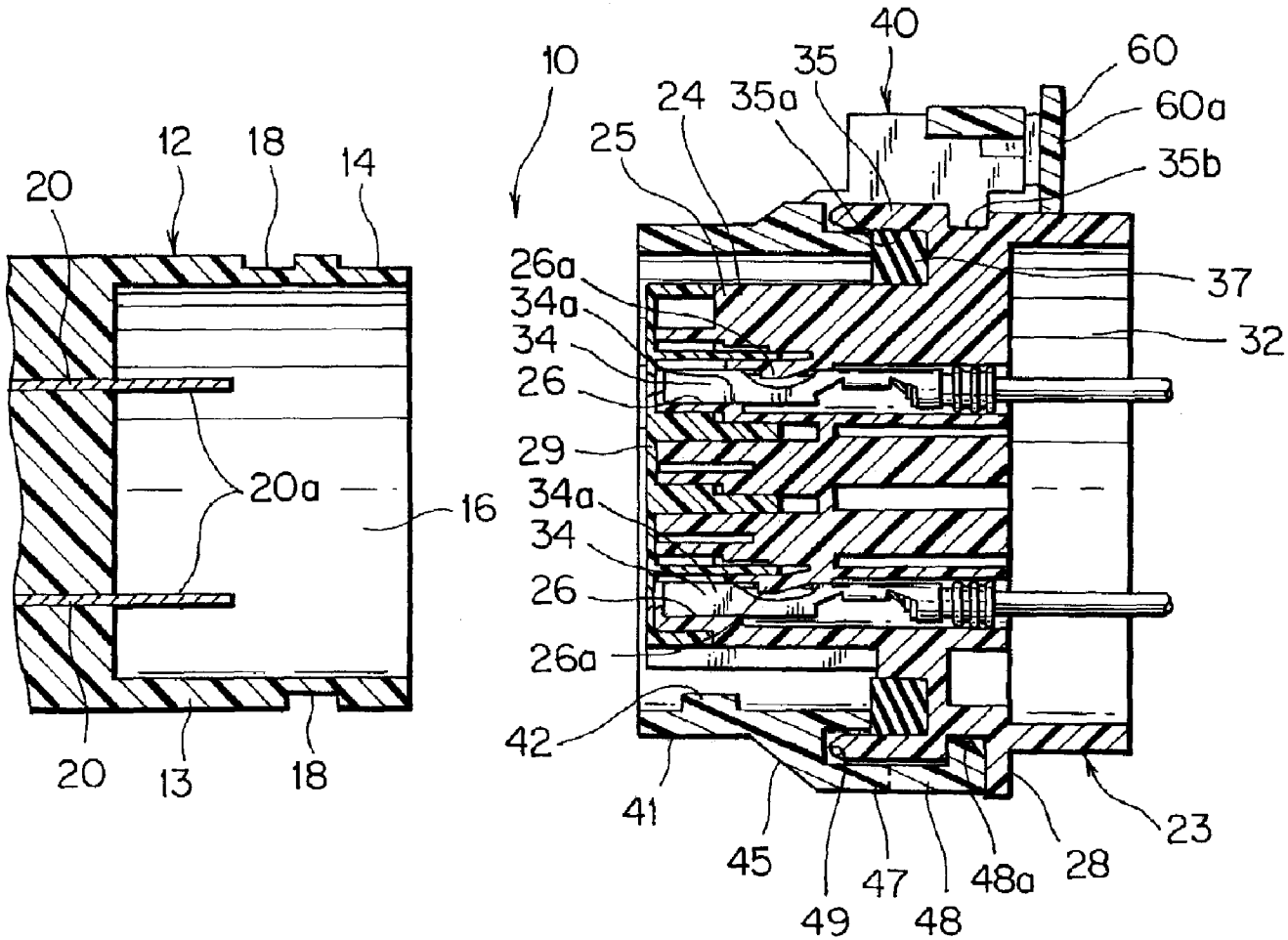
FIG. 2 shows cross sections showing male and female connectors shown in FIG. 1 according to this invention.

The female connector 12 includes a female connector housing 13 and male terminals 20. The female connector housing 13 is made of synthetic resin such as polypropylene, or polyethylene terephthalate, and formed in a cylinder shape by an injection molding process. A connector engaging part 14 for receiving the mating male connector housing 24 inserting is provided at a front side of the female connector 12. An electric wire leading part 15 for leading out electric wires electrically connected to the male terminals is provided at a rear side of the female connector 12. As shown in FIG. 2, an engaging space 16 is provided at an interior of the connector engaging part 14. A plurality of electric contacts 20*a* of male terminals 20 project toward a direction of engaging the connectors 23, 12 with each other.

Spiral grooves 18 for engaging with projections 42 projecting from an inner surface of the engaging ring 40 are provided on an outer surface of the connector engaging part 14. Three spiral grooves 18 are arranged at even intervals in a circumferential direction, and formed spirally in a specific lead angle. An open end 18*a* for inserting the projection 42 is provided at one end of each spiral groove 18. A close end 18*b*, for preventing the engaging ring 40 from rotating further by contacting with the projection 42 by blocking the projection 42, is provided at the other end of each spiral groove 18. A length of each spiral groove 18 in an axial direction of the connectors 23, 12 is equal to an engagement length between the connectors 23, 12.

The open end 18*a* of each spiral groove 18 has a straight part extending toward the direction of engaging the connectors 23, 12 with each other. Thereby, the engaging ring 40 is firstly pushed onto the female connector housing 13 and engaged shallowly, then rotated in a clockwise direction to be engaged deeply with the female connector housing 13. A triangular alignment mark 17 indicating a reference position for assembly is provided at a position corresponding to the open end 18*a* of the spiral grooves 18 on the outer surface of the connector engaging part 14. An identifying groove 43 is provided corresponding to the alignment mark 17 on the engaging ring 40.

Incidentally, the number of the spiral grooves 18 is optional, and may be one or two. However, three spiral grooves in this embodiment makes a clearance between the neighboring spiral grooves narrower, and allow the connectors 23, 12 to be engaged with each other in a short time with no shake. A numeric value of the lead angle of the spiral grooves 18 is also optional. A small lead angle allows to engage the connectors 23, 12 with each other with a small torque, and prevents the engagement between the connectors 23, 12 from loosening by such as vibrations of the connectors 23, 12.

As shown in FIG. 2, the male connector 23 includes the male connector housing 24 and the female terminals 34. The male connector housing 24 is made of synthetic resin by an injection molding process like the female connector housing 13. The male connector housing 24 includes a main housing body 25, a hood 35 provided at a rear side of the main housing body 25, and an electric wire leading part 32 provided as an opening at a rear end of the main housing body 25.

A plurality of terminal receiving chambers 26 are provided through the main housing body 25 at positions corresponding to the male terminals 20. The female terminals 34 connected to the electric wires are inserted into the terminal receiving chambers 26 from the rear opening of the terminal receiving chambers 26. The electric contacts 20*a* of the male terminals 20 are inserted into the terminal receiving chambers 26 from front openings of the terminal receiving chambers 26. Thereby, the electric contacts 20*a* are electrically connected to electrical contacts 34*a* of the female terminals 34. Housing locking lances 26*a* are provided in the terminal receiving chambers 26, and a front holder 29 is attached to the terminal receiving chambers 26. Thereby, the female terminals 34 are doubly engaged.

As shown in FIG. 1, an alignment groove 27 for aligning with the female connector housing 13 is provided on an outer surface of the main housing body 25 in the direction of engaging the connectors 23, 12 with each other. When the connectors 23, 12 are engaged with each other, an alignment projection (not shown) provided on an inner surface of the connector engaging part 14 is engaged with the alignment groove 27. Thereby, the connectors 23, 12 are engaged with each other without misalignment.

Figure 3:
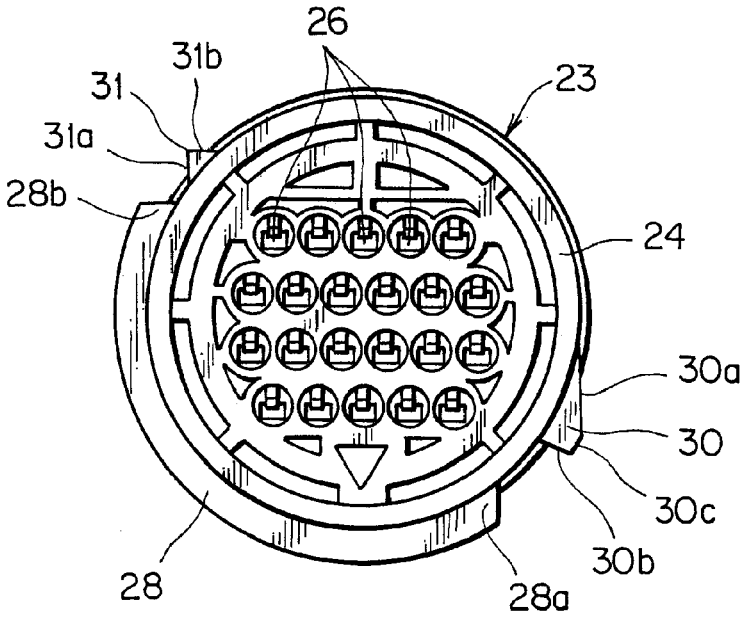
FIG. 3 is a rear view showing the male connector housing according to this invention.
Figure 5:
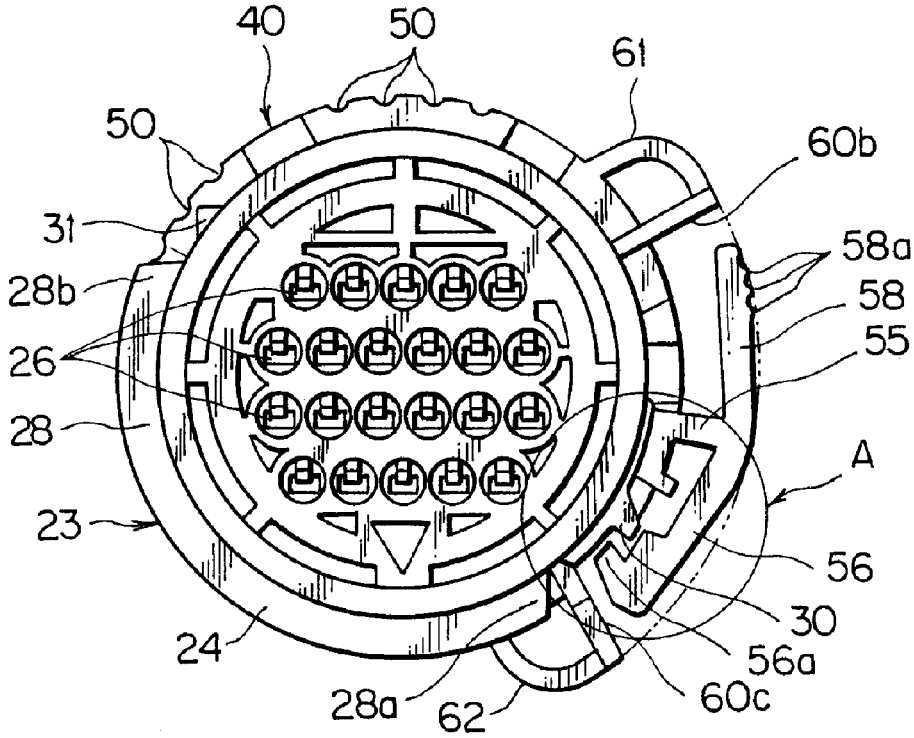
FIG. 5 is a rear view showing the male connector fully engaged with the female connector according to this invention.

As shown in FIG. 3, a flange 28 having a sector shape is projected outward in a radial direction on an outer periphery of the rear side of the main housing body 25. Each of both ends 28*a*, 28*b* of the flange 28 functions as a stopper for blocking a rotation of the engaging ring 40. As shown in FIG. 5, the end 28*a* blocks a wall 60*c* provided on the engaging ring 40 in an axial direction of the engaging ring 40 to prevent the engaging ring 40 from rotating further in a clockwise direction. The end 28*b* blocks a wall 60*b* provided on the engaging ring 40 in the axial direction of the engaging ring 40 to prevent the engaging ring 40 from rotating further in a counterclockwise direction.

A detecting locking projection 30 is projected outward at the end 28*a* side, in the radial direction on the outer periphery of the rear side of the main housing body 25, on an arc on which the flange 28 is not provided. The temporary locking projection 31 is projected outward near the end 28*b* in the radial direction on the outer periphery of the rear side of the main housing body 25. A circumferential length between the detecting locking projection 30 and the temporary locking projection 31 is designed to be equal to a moving distance in a circumferential direction of the engaging ring 40 from an initial engagement to a full engagement between the connectors 23, 12.

The temporary locking projection 31 is in a triangular shape having inclined planes 31*a*, 31*b* at both sides. By locking the wall 60*b* of the engaging ring 40 at the temporary locking projection 31, the engaging ring 40 is assembled at the reference position for assembly. When the engaging ring 40 is rotated in the clockwise direction, the wall 60*b* goes over the inclined plane 31*a*, and the engaging ring 40 is unlocked.

Figure 6:
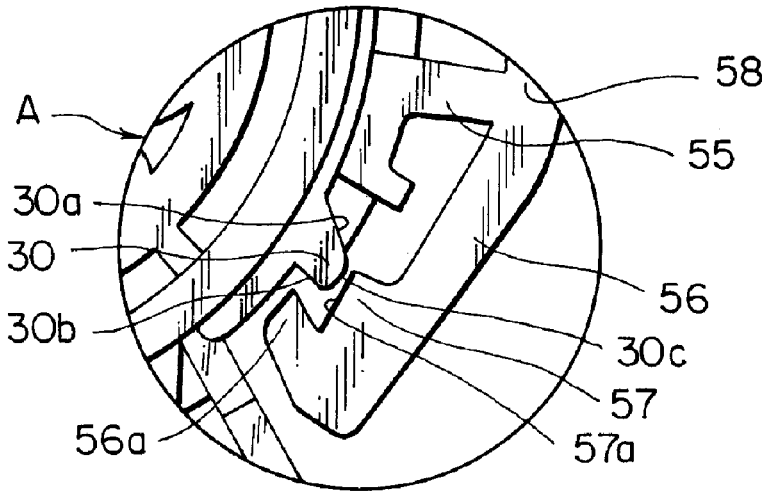
FIG. 6 is a partially enlarged view of a part A in FIG. 5 according to this invention.
Figure 7:
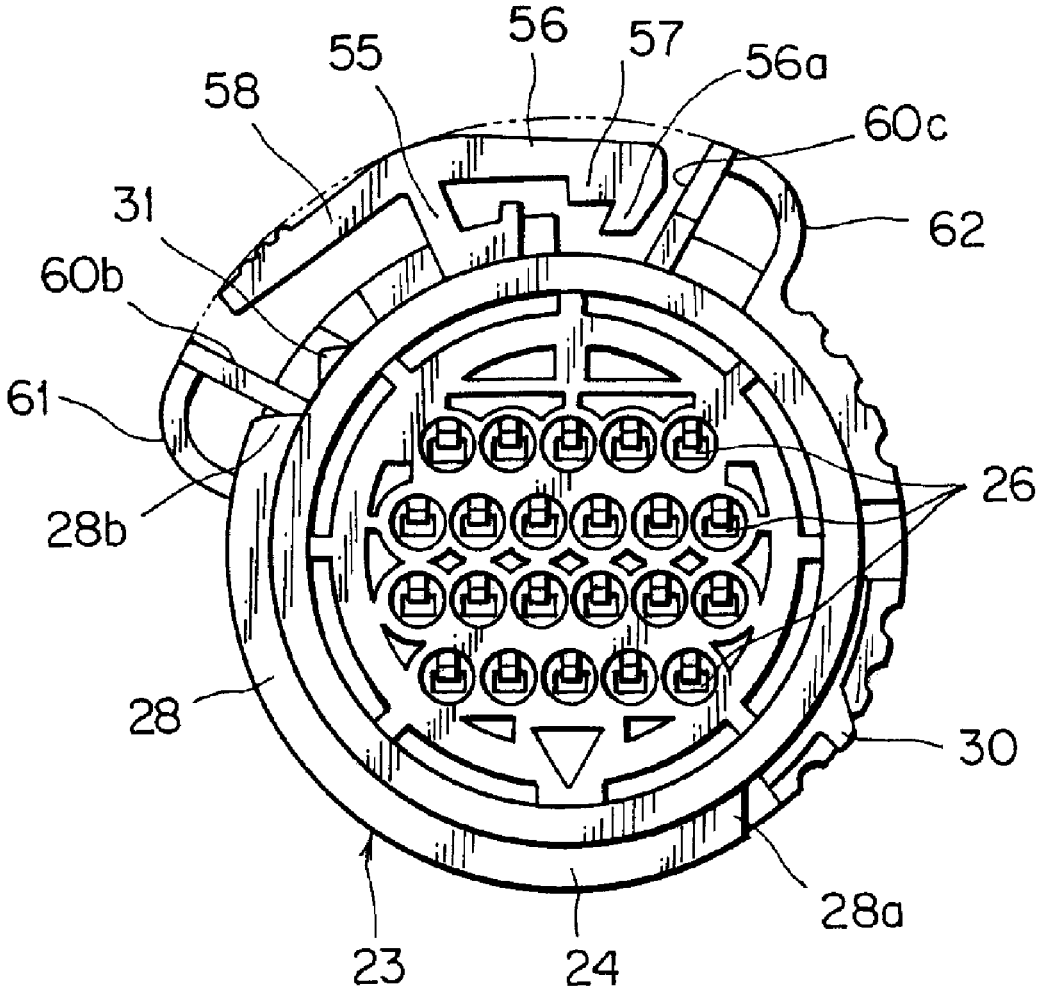
FIG. 7 is a rear view showing the male connector initially engaged with the female connector according to this invention.
Figure 8:
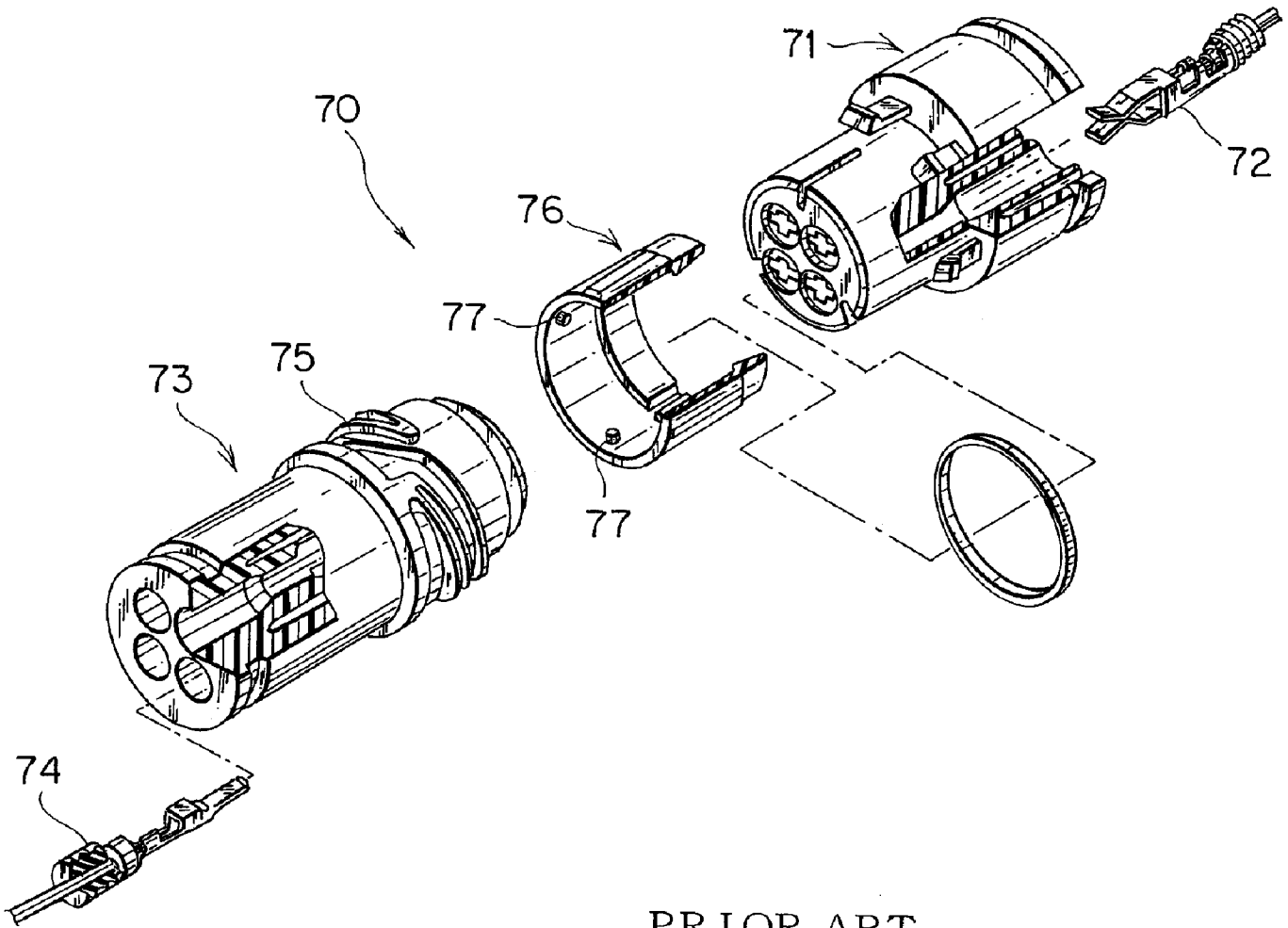
PRIOR ART FIG. 8
FIG. 8 is a perspective view showing a conventional circular connector assembly.
Figure 9:
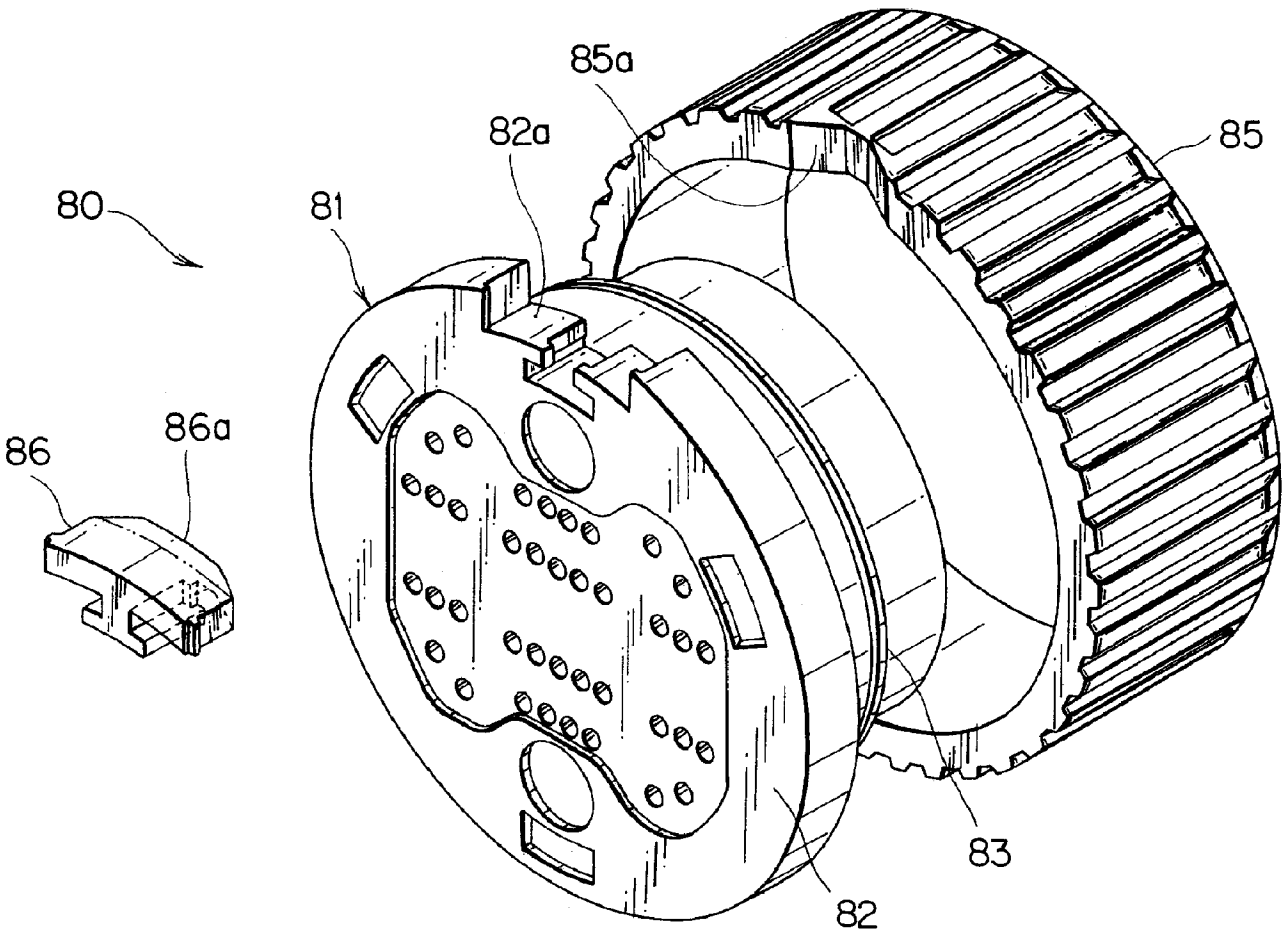
PRIOR ART FIG. 9
FIG. 9 is a perspective view showing another conventional circular connector assembly.

The detecting locking projection 30 located opposed to the temporary locking projection 31 includes an inclined plane 30*a* at a rear side in the rotating direction of the engaging ring 40, and a vertical locking plane 30*b* at a front side in the rotating direction of the engaging ring 40. As shown in FIGS. 5 and 6, when the engaging ring 40 is rotated in the clockwise direction, the locking hook 56*a* of the resilient locking arm 56 is rotated on the inclined plane 30*a*, and the resilient locking arm 56 is resiliently deformed outward in the radial direction around a base of the resilient locking arm 56. When the resilient locking arm 56 passes over the detecting locking projection 30, the resilient locking arm 56 is resiliently restored, and the locking hook 56*a* contacts the vertical locking plane 30*b* of the detecting locking projection 30 to be locked.

An engagement between the locking hook 56*a* and the detecting locking projection 30 indicates the full engagement between the male and female connectors 23, 12. A disengagement between the locking hook 56*a* and the detecting locking projection 30 indicates a half-engagement between the male and female connectors 23, 12.

A flat or curved contact surface 30*c* is provided between the inclined planes 30*a* and 30*b*. A contact surface 57*a* of the step 57 provided near an end of the resilient locking arm 56 hits the contact surface 30*c* due to resilient restoring force of the resilient locking arm 56. Thereby, a locking sound is generated to indicate the full engagement of the connectors 23, 12. Thus, the full engagement of the connectors 23, 12 is recognized not only visually, but also aurally.

As shown in FIG. 2, the hood 35 is provided in a middle of the male connector housing 24. A sealant-receiving chamber 35*a* for receiving a circular sealant 37 is provided inside the hood 35. When the connectors 23, 12 are engaged with each other, an open end of the connector engaging part 14 pushes the sealant 37 to tightly contact the sealant 37. Thereby, for example, outside water is prevented from entering an interior of the engaging connectors 23, 12.

A circular guiding groove 35*b* is provided at a rear side of the hood 35. A plurality of hooks 48*a* of resilient holding pieces 48 provided around the engaging ring 40 are engaged with the guiding groove 35*b*. When the engaging ring 40 is rotated, the guiding groove guides the hooks 48*a*. Thereby, the engaging ring 40 is prevented from being removed from the main housing body 25.

As shown in FIG. 1, the engaging ring 40 is in a stepped cylinder shape, having a small diameter part 41, a tapered part 45 continued from the small diameter part 41, and a large diameter part 47 continued from the tapered part 45. The small diameter part 41 receives the female connector housing 13. An inner diameter of the small diameter part 41 is slightly larger than an outer diameter of the female connector housing 13. Three projections 42 are provided on an inner surface of the small diameter part 41 for engaging with the three spiral grooves 18 on the outer surface of the female connector housing 13. The projections 42 are arranged at even intervals in a circumferential direction of the small diameter part 41. A shape of each projection 42 is not limited, however, the projection 42 having a round button shape allows a smooth insertion of the projection 42 into the spiral groove 18. An identifying groove 43 having a slot shape is provided on an outer surface of the small diameter part 41 for indicating the reference position for assembling the engaging ring 40.

The tapered part 45 is located in between the small diameter part 41 and the large diameter part 47. A plurality of holes 45*a* are provided on the tapered part 45 for molding the resilient holding pieces 48 provided on the large diameter part 47.

As shown in FIG. 2, the large diameter part 47 includes a circular receiving chamber 49 to receive a front end part of the hood 35 and prevent outside water from entering the receiving chamber 49. A plurality of the resilient holding pieces 48 are provided around the engaging ring 40 to hold the engaging ring 40 rotatably on the male connector housing 24. A plurality of the hooks 48*a* engaging with the guiding groove 35*b* are projected inwardly from an inner surface of the resilient holding pieces 48. Thereby, the engaging ring 40 is hold and prevented from being removed from the male connector housing 24.

As shown in FIG. 1, a pillar 55 is projected outward in a radial direction from a part of an outer surface of the large diameter part 47, on which no straight grooves 50 extending in an axial direction of the large diameter part 47 to prevent slipping is provided. The resilient locking arm 56 is extended forward of the pillar 55 in the rotating direction around the engaging ring 40 from a front end of the pillar 55. An unlocking arm 58 is extended backward of the pillar 55 in the rotating direction around the engaging ring 40 and integrated into the resilient locking arm 56.

Figure 4:
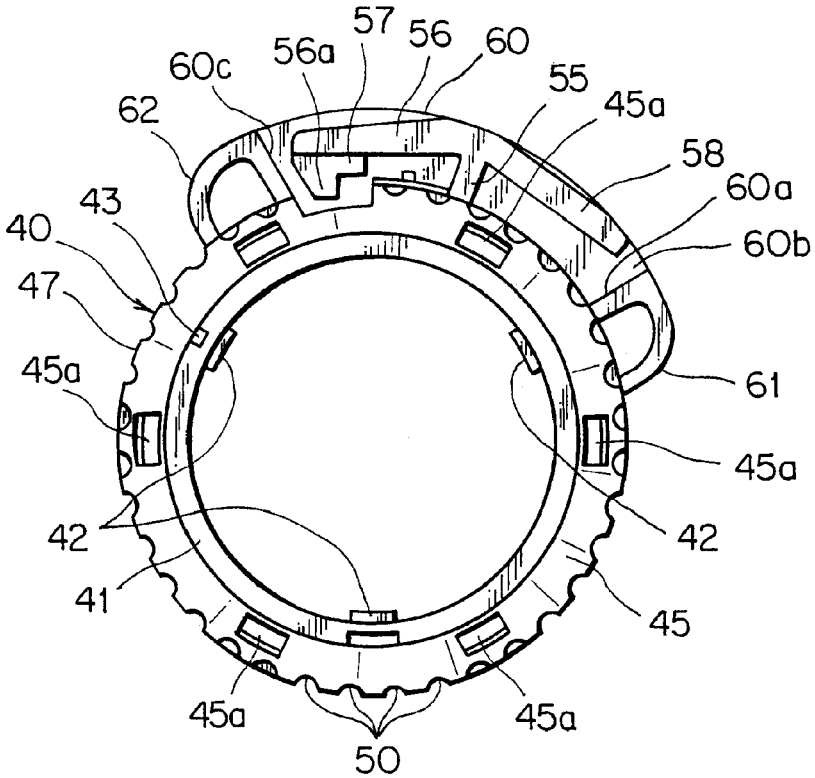
FIG. 4 is a front view showing an engaging ring according to this invention.

As shown in FIG. 4, the locking hook 56*a* for engaging with the detecting locking projection 30 of the male connector housing 24 is projected inwardly from a front end of the resilient locking arm 56. The step 57 for contacting the contact surface 30*c* of the detecting locking projection 30 is provided near a base of the locking hook 56*a*. The step 57 includes the contact surface 57*a* for contacting the contact surface 30*c*. A collision between the contact surface 57 and the contact surface 30*c* generates the locking sound indicating the full engagement between the connectors 23, 12. Designing a projection length of the locking hook 56*a*, in a manner that the front end of the locking hook 56*a* may not touch the male connector housing 24 when the step 57 contacts the detecting locking projection 30, allows to generate a louder locking sound.

As shown in FIG. 1, the unlocking arm 58 is extended in a counter direction to the resilient locking arm 56 with reference to the pillar 55. A front end of the unlocking arm 58 has a wide width shape, and a plurality of straight grooves on an outer surface thereof to prevent slipping. By pushing the unlocking arm 58 with a finger, the unlocking arm 58 is resiliently deformed inwardly in the radial direction around a base of the unlocking arm 58, and the resilient locking arm 56 is resiliently deformed outward. Thereby, the engagement between the locking hook 56*a* and the detecting locking projection 30 is released, and the engaging ring 40 becomes rotatable in the counterclockwise direction. In this condition, a rotation of the engaging ring 40 in the counterclockwise condition removes the connectors 23, 12 from each other easily.

Protecting walls 60 in a U shape surround the resilient locking arm 56 and unlocking arm 58 to protect them from such as outer interference. The protecting wall 60 includes a coupling wall 60*a* provided in the circumferential direction, and walls 60*b*, 60*c* provided in the axial direction of the engaging ring 40, perpendicular to the coupling wall 60*a*, and coupled to the coupling wall 60*a* respectively at both ends of the coupling wall 60*a*. The coupling wall 60*a* extends over and parallel to the resilient locking arm 56 and the unlocking arm 58. Each width of the walls 60*b* and 60*c* are substantially equal to a length of the large diameter part 47 in the axis direction, and longer than each of the resilient locking arm 56 and the unlocking arm 58, so that ends of the resilient locking arm 56 and the unlocking arm 58 may not protrude from front ends of the walls 60*b*, 60*c*. Further, arc-shaped ribs 61, 62 reinforce the walls 60*b*, 60*c* to prevent the walls 60*b*, 60*c* from collapsing in a thickness direction of the walls 60*b*, 60*c*. Therefore, the protecting walls 60 protect the resilient locking arm from outer interference, and accidental release of an engagement between the resilient locking arm 56 and the detecting locking projection 30 is prevented.

The wall 60*b* is used for a temporary locking wall to be engaged with the temporary locking projection 31 of the male connector housing 24. By engaging the wall 60*b* with the temporary locking projection 31, the engaging ring 40 is assembled at the reference position for assembly, and allows the initial shallow engagement between the connectors 23, 12.

Next, steps for assembling the circular connector assembly 10 by engaging the connectors 23, 12 with each other will be explained. After a lot of male terminals 20 having electric wires are pressed into the female connector housing 13, the female connector 12 is mounted on an apparatus of such as a transmission. The male connector 23 is assembled by inserting a lot of female terminals 34 having the electric wires into the terminal receiving chambers 26 of the male connector housing 24, and by attaching the front holder 29 from an open end of the male connector housing 24 to the terminal receiving chambers 26. The female terminals 34 are engaged doubly by the housing locking lances 26*a* and the front holder 29 to be prevented from moving out of the terminal receiving chambers 26 backward when the male and female terminals 20, 34 are connected to each other. The electric contacts 20*a* of the male terminals 20 are inserted into the terminal receiving chambers 26 from front openings of the terminal receiving chambers 26. Thereby, the electric contacts 20*a* are electrically connected to electrical contacts 34*a* of the female terminals 34. The sealant-receiving chamber 35*a* for receiving a circular sealant 37 is provided inside the hood 35. The engaging ring 40 is assembled at a front side of the male connector 23.

The large diameter part 47 of the engaging ring 40 includes the circular receiving chamber 49 to receive the front end part of the hood 35 and prevent outside water from entering the receiving chamber 49. The circular guiding groove 35*b* is provided at the rear side of the hood 35. A plurality of the hooks 48*a* of resilient holding pieces 48 provided around the engaging ring 40 are engaged with the guiding groove 35*b* and support the engaging ring 40 rotatably.

Next, the male connector 23 is positioned to face the female connector 12. The alignment projection (not shown) provided on the inner surface of the female connector housing 13 is engaged with the alignment groove 27 to align the connectors 23, 12 in the circumferential direction. The projections 42 projecting from the inner surface of the engaging ring 40 are inserted into the spiral grooves 18 of the female connector housing 13. The wall 60*b* is engaged with the temporary locking projection 31. Thus, the connectors 23, 12 are initially and shallowly engaged with each other. Next, by rotating the engaging ring 40 in the clockwise direction from the reference position for assembly, the projections 42 are moved along the spiral grooves 18 and the connectors 23, 12 are moved to be engaged with each other. By rotating the engaging ring 40 further, the connectors 23, 12 are fully engaged with each other. Further, the locking hook 56*a* is passed over the detecting locking projection 30 of the male connector housing 24, and engaged with the detecting locking projection 30, while generating a locking sound to indicate a full engagement between the male and female connectors 23, 12.

Thus, the circular connector assembly 10 of this embodiment allows to recognize a full engaging state of the male and female connectors 23, 12 visually, aurally, and by a feel of a rotation of the engaging ring 40. Therefore, the reliability of the engagement between the connectors 23, 12 is significantly improved.

Incidentally, this invention is not limited to the embodiment described above. Various embodiments can be adopted to this invention. For an example, the engaging ring 40 may be assembled on the fixed female connector 12, instead of being assembled on the movable male connector 23. For another example, the detecting locking projection 30 provided on the outer periphery of the male connector housing 24 may be a detecting concave.

Having now fully described the invention, it will be apparent to one of ordinary skill in the art that many changes and modifications can be made thereto without departing from the scope of the invention as set forth herein.

What is claimed is:

1. A circular connector assembly comprising:

a rotatable engaging ring arranged in between male and female connectors for moving the connectors in a direction of engaging the connectors with each other;

a detector being provided on an outer surface of one of the male and female connectors on which the engaging ring is mounted, for detecting a fitting state of the connectors and preventing the engaging ring from rotating in a reverse direction; and a resilient locking arm being provided to form a free end on the engaging ring, extending in a rotating direction of the engaging ring for engaging with the detector, wherein the resilient locking arm intersects with a support projecting from an outer peripheral wall of the engaging ring, wherein a locking part and an unlocking part are provided integrally on both sides of the locking arm respectively.

2. The circular connector assembly as claimed in claim 1, further comprising:

a temporary locking projection provided on an outer peripheral wall of one of the male and female connectors on which the engaging ring is mounted; and a temporary locking wall provided on the engaging ring to be engaged with the temporary locking projection for locking the engaging ring at a reference position for assembly.

3. The circular connector assembly as claimed in claim 1, further comprising:

protecting walls provided on the engaging ring at both sides of the resilient locking arm in a circumferential direction of the engaging ring; and a coupling wall provided on the engaging ring along the resilient locking arm in the circumferential direction of the engaging ring for coupling the protecting walls, wherein the protecting and coupling walls are taller than the resilient locking arm projecting from the engaging ring.

4. The circular connector assembly as claimed in claim 1, wherein the detector is a locking projection having a contact surface for contacting the resilient locking arm, wherein the resilient locking arm includes a step having a contact surface for contacting the contact surface of the locking projection.

5. A circular connector assembly comprising:

a rotatable engaging ring arranged in between male and female connectors for moving the connectors in a direction of engaging the connectors with each other;

a detector being provided on an outer surface of one of the male and female connectors on which the engaging ring is mounted, for detecting a fitting state of the connectors and preventing the engaging ring from rotating in a reverse direction; and a resilient locking arm being provided to form a free end on the engaging ring, extending in a rotating direction of the engaging ring for engaging with the detector, wherein the detector is a locking projection having a contact surface for contacting the resilient locking arm, wherein the resilient locking arm includes a step having a contact surface for contacting the contact surface of the locking projection, wherein a slope is provided on a rear of the detector in a rotating direction of the engaging ring, wherein a locking surface is provided on a front side of the detector in a rotating direction of the engaging ring, wherein a locking hook, to be passed over the slope and locked on the locking surface of the detector, is projected inwardly from the resilient locking arm.

6. The circular connector assembly as claimed in claim 5, wherein when the engaging ring is rotated in a reverse direction, the locking hook of the resilient locking arm so contacts the locking surface of the detector as to be drawn inwardly in a radial direction of the engaging ring.

* * * * *